US008302666B2

(12) United States Patent
Hwang et al.

(10) Patent No.: US 8,302,666 B2
(45) Date of Patent: Nov. 6, 2012

(54) METHOD OF CONTINUOUS CASTING OF BEAM BLANK

(75) Inventors: Seangjun Hwang, Pohang-si (KR); Jeongjae Kim, Pohang-si (KR); Pankeun Kim, Pohang-si (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 13/310,662

(22) Filed: Dec. 2, 2011

(65) Prior Publication Data

US 2012/0073779 A1 Mar. 29, 2012

Related U.S. Application Data

(63) Continuation of application No. PCT/KR2010/004128, filed on Jun. 25, 2010.

(30) Foreign Application Priority Data

Dec. 24, 2009 (KR) ..... 10-2009-0130460

(51) Int. Cl.
*B22D 11/00* (2006.01)

(52) U.S. Cl. ..... 164/461; 164/483

(58) Field of Classification Search ..... 164/483, 164/425–426, 445–446, 459, 418, 419, 461, 164/437–439, 488–489
See application file for complete search history.

(56) References Cited

U.S. PATENT DOCUMENTS

| | | | | |
|---|---|---|---|---|
| 4,487,251 | A * | 12/1984 | Cahoon et al. | 164/475 |
| 2007/0009373 | A1 * | 1/2007 | Omoto et al. | 419/34 |
| 2009/0233081 | A1 * | 9/2009 | Morikawa et al. | 428/315.5 |

FOREIGN PATENT DOCUMENTS

| | | | |
|---|---|---|---|
| JP | 55-33872 | * | 3/1980 |
| JP | 11-5144 | * | 1/1999 |
| JP | 2001-259800 | A | 9/2001 |
| KR | 10-1996-0002403 | B1 | 2/1996 |
| KR | 10-2003-0095011 | A | 12/2003 |
| KR | 10-2004-0011015 | A | 2/2004 |
| KR | 10-2006-0032239 | A | 4/2006 |

OTHER PUBLICATIONS

International Search Report dated Feb. 1, 2011 of PCT/KR2010/004128 and its English Translation (4 pages).
Written Opinion dated Feb. 1, 2011 of PCT/KR2010/004128 (5 pages).

* cited by examiner

*Primary Examiner* — Kuang Lin
(74) *Attorney, Agent, or Firm* — Knobbe Martens Olson & Bear, LLP

(57) ABSTRACT

A method of continuous casting a beam blank adapted for impact absorption is disclosed. The method includes: introducing molten steel into a continuous casting mold from a tundish through an immersion nozzle to perform non-oxidation casting, wherein the immersion nozzle is disposed at one side of the continuous casting mold forming both side flanges of a beam blank, and the molten steel is introduced into the continuous casting mold through the immersion nozzle. The method is advantageous in that it is possible to produce steel adapted for low-temperature impact absorption, and productivity is improved due to the increase of the number of consecutive heats of continuous casting.

9 Claims, 5 Drawing Sheets

METHOD OF CONTINUOUS CASTING OF BEAM BLANK

RELATED APPLICATION

This application is a continuation application under 35 U.S.C. §365(c) of International Application No. PCT/KR2010/004128, filed Jun. 25, 2010 designating the United States. This application further claims the benefit of the earlier filing date under 35 U.S.C. §365(b) of Korean Patent Application No. 10-2009-0130460 filed Dec. 24, 2009. This application incorporates herein by reference the International Application No. PCT/KR2010/004128 and the Korean Patent Application No. 10-2009-0130460 in their entirety.

TECHNICAL FIELD

The present disclosure relates to a method of continuous casting of a beam blank.

BACKGROUND ART

Continuous casting is a series of processes for producing cast products, such as billets, blooms, beam blanks and slabs, by continuously introducing molten steel into a mold having a predetermined shape.

In a continuous casting system, about 20% of the liquid molten steel solidifies while passing through a mold, and then 80% of the remaining liquid molten steel completely solidifies while passing through a strand, thus being made into solid cast products.

SUMMARY

An aspect of the present invention is to provide a method of continuous casting a beam blank adapted for impact absorption, in which non-oxidation casting can be conducted when aluminum (Al) is added in order to produce a beam blank adapted for impact absorption.

An aspect of the present invention provides a method of continuous casting a beam blank adapted for impact absorption, the method including: introducing molten steel into a continuous casting mold from a tundish through an immersion nozzle to perform non-oxidation casting, wherein the immersion nozzle is disposed at one side of the continuous casting mold forming both side flanges of a beam blank, and the molten steel is introduced into the continuous casting mold through the immersion nozzle.

The immersion nozzle may be a straight-type immersion nozzle whose molten steel outlet opens downward.

Mold powder, including CaO in an amount of 32.7~33.7 wt %, $SiO_2$ in an amount of 29.3~30.3 wt %, $Al_2O_3$ in an amount of 8.90~9.90 wt %, $Na_2O$ in an amount of 1.8~2.8 wt %, F in an amount of 1.10~2.10 wt % and C in an amount of 15.6~16.6 wt % as main components, may be supplied to an inner wall of the continuous casting mold.

Compound continuous-continuous casting may be conducted without drawing a cast piece after molten steel stays in the continuous casting mold and then the tundish is replaced.

The tundish may be replaced within 5 minutes.

The level of the molten steel staying in the continuous casting mold may be maintained to range 25~35%.

A connecting rod may be provided in the molten steel at a location opposite to the location where the immersion nozzle is disposed in the continuous casting mold after mold powder is removed.

The introduction rate of the molten steel in the continuous casting mold after replacing the tundish may be maintained at 0.55~0.7 m/min.

According to embodiments of the present invention, molten steel is introduced into a continuous casting mold from a tundish through an immersion nozzle, and the immersion nozzle is disposed at one side of the continuous casting mold forming both side flanges of a beam blank.

Thus, it is possible to prevent molten steel from reoxidizing and to prevent the immersion nozzle from clogging, so that it is possible to produce steel adapted for low-temperature impact absorption, and the time taken to install a connecting rod in a tundish at the time of replacing the tundish is shortened.

Further, according to embodiments of the present invention, a straight-type immersion nozzle whose molten steel outlet opens downward is employed, and thus the life span of the immersion nozzle is increased, and the reduced number of consecutive heats of continuous casting is compensated as open nozzles are not used.

Further, according to embodiments of the present invention, compound continuous-continuous casting, in which continuous casting is conducted without drawing a cast piece after molten steel stays in a continuous casting mold and then a tundish is replaced, is used.

Therefore, embodiments of the present invention are advantageous in that high-quality steel adapted for low-temperature impact absorption can be produced, and continuous casting time can be shortened, so that the number of consecutive heats of continuous casting increases, thereby improving productivity.

DESCRIPTION OF ESSENTIAL ELEMENTS IN THE DRAWINGS

Figure 1:
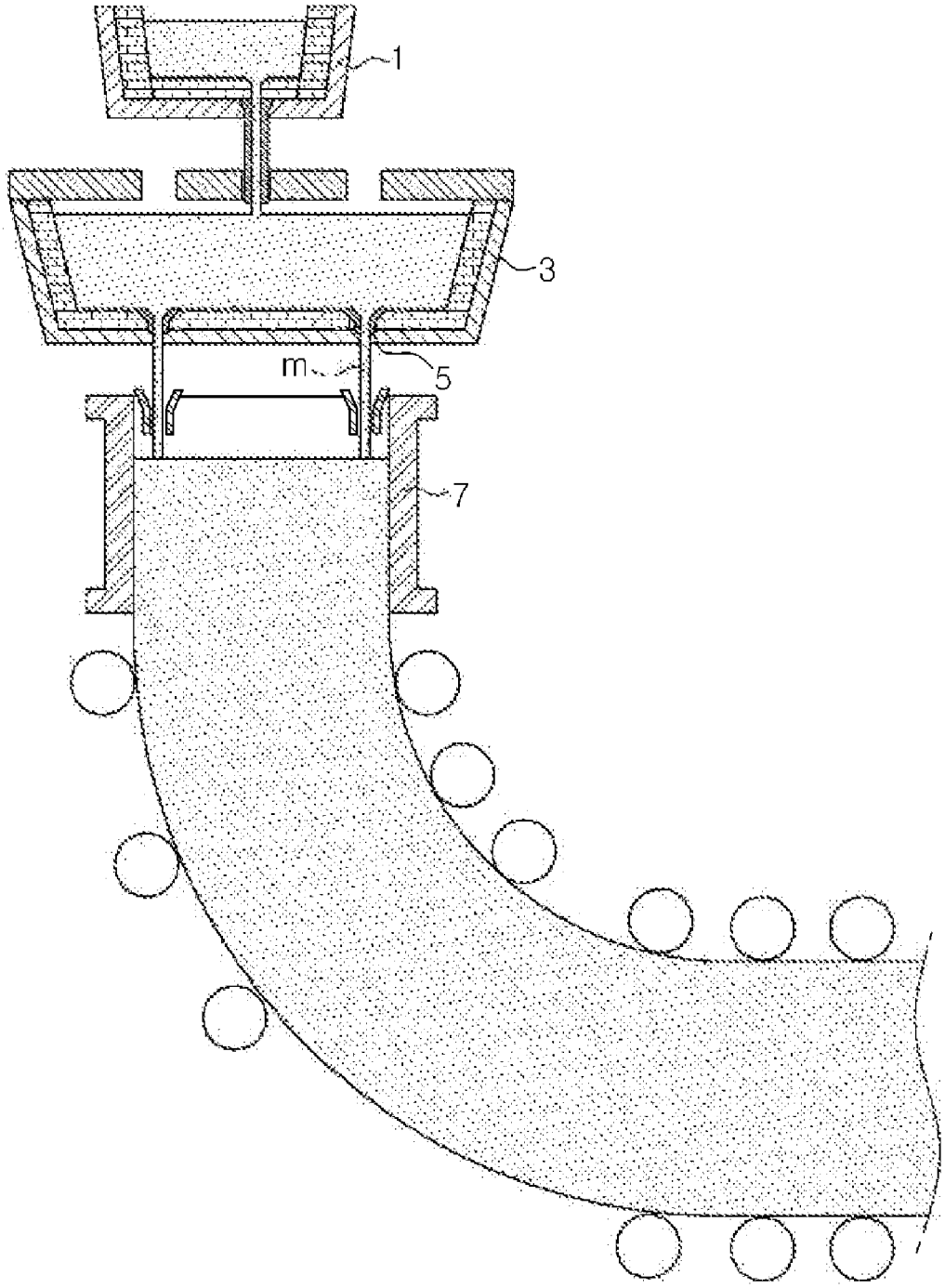
FIG. 1 is a sectional side view showing a continuous casting system provided with open nozzles according to Comparative Example of in Table 1.
Figure 2:
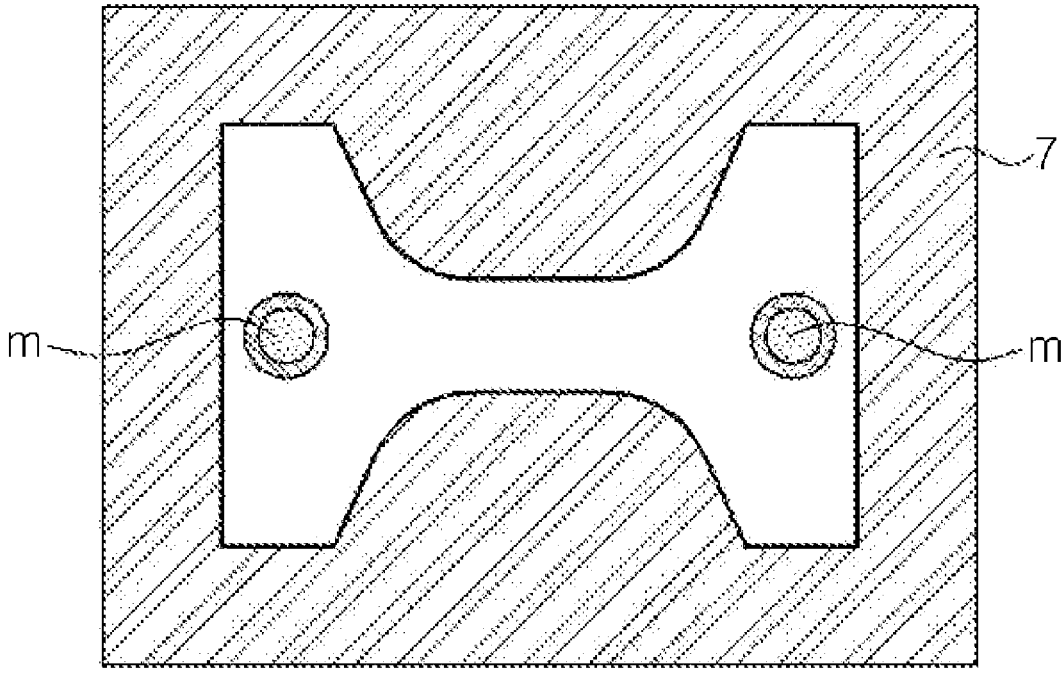
FIG. 2 is a plan view showing a continuous casting system provided with open nozzles according to the Comparative Example of Table 1.

1: ladle
3: tundish
5: open nozzle
7: continuous casting mold
9: immersion nozzle
11: connecting rod
13: connection part
m, M: molten steel.

EMBODIMENTS

Hereinafter, embodiments of the present invention will be described in detail with reference to the accompanying drawings.

Figure 3:
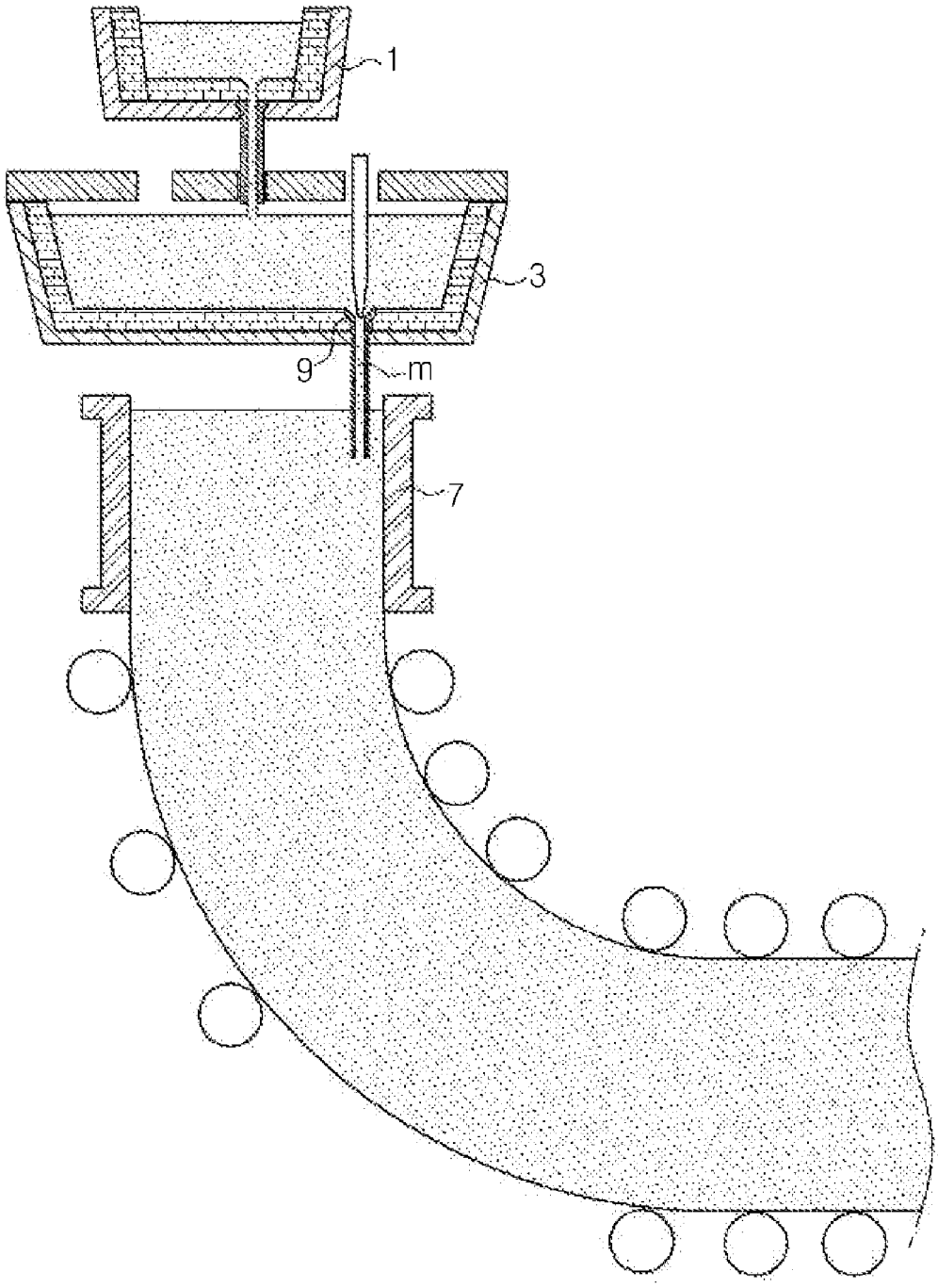
FIG. 3 is a sectional side view showing a continuous casting system provided with an immersion nozzle according to the Example of Table 1.

In the method of continuous casting a beam blank adapted for impact absorption according to embodiments of the present invention, as shown in FIG. 3, the molten steel having undergone a refining process is introduced into a tundish 3 from a ladle 1, and then the molten steel (m) charged in the tundish 3 is introduced into a continuous casting mold 7 through an immersion nozzle 9.

The immersion nozzle 9 is used in order to produce steel adapted for low-temperature impact absorption.

Since steel adapted for low-temperature impact absorption includes aluminum (Al), as shown in FIG. 1, when molten steel (m) is introduced into a continuous casting mold 7 through open nozzles 5, the molten steel stream is exposed to atmosphere, and thus the molten steel is thoroughly reoxidized.

Due to the reoxidation of molten steel, the open nozzles 5 are clogged, and a large-size product is formed on the surface thereof with gaseous defects because its rolling ratio decreases.

Therefore, in order to prevent molten steel from reoxidizing at the time of producing steel adapted for low-temperature impact absorption, as shown in FIG. 3, an immersion nozzle 9 whose end is located in a continuous casting mold 7 is used. The immersion nozzle 9 serves to inhibit the contact between molten steel (m) and atmosphere when the molten steel (m) is introduced into the continuous casting mold 7 from the tundish 3, so that non-oxidizing casting can be performed.

Figure 4:
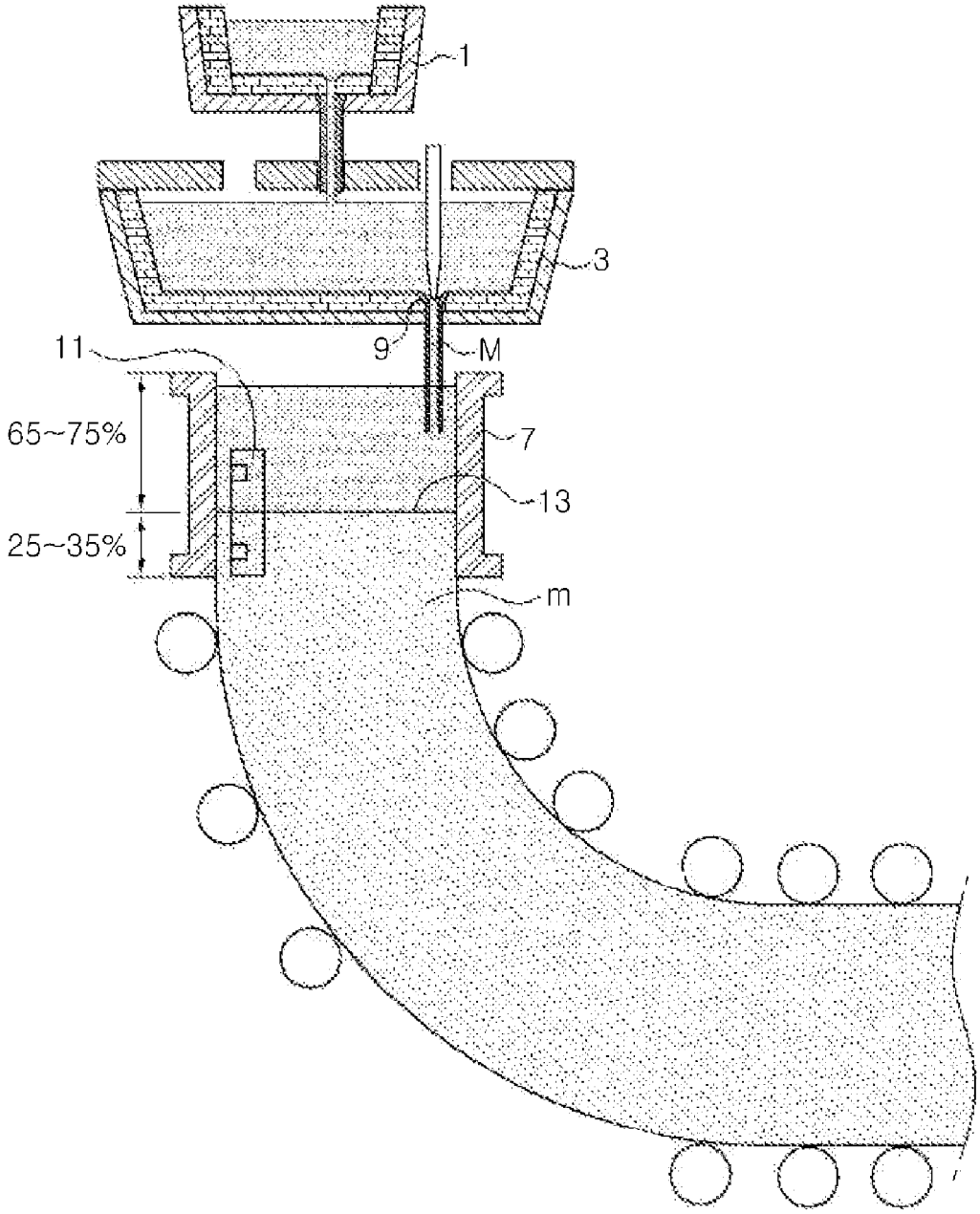
FIG. 4 is a sectional side view showing a continuous casting system provided with an immersion nozzle and a connecting rod according to the Example of Table 1.
Figure 5:
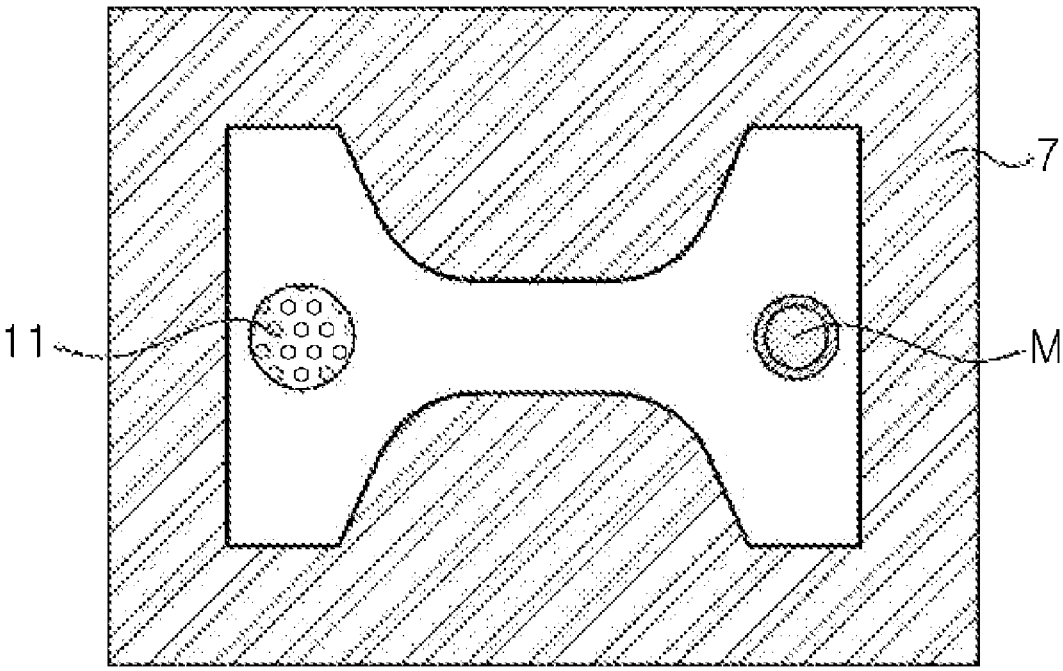
FIG. 5 is a plan view showing a continuous casting system provided with an immersion nozzle and a connecting rod according to the Example of Table 1.

As shown in FIGS. 3 to 5, the immersion nozzle 9 is disposed at one side of the continuous casting mold 7 forming both side flanges of a beam blank, and molten steel (m) is introduced into the continuous casting mold 7 through the immersion nozzle 9. Due to the position of the immersion nozzle 9, at the time of replacing the tundish 3 to perform continuous casting, the time for installing a connecting rod in the continuous casting mold 7 is shortened, and thus the time for continuous casting is reduced. In this case, the uniform solidification of molten steel is not influenced by the position of the immersion nozzle.

In order to improve the life span of the immersion nozzle 9, a straight-type immersion nozzle whose molten steel outlet is opened downward is employed as the immersion nozzle 9. Since the inner diameter of the straight-type immersion nozzle is larger than that of a hole-type immersion nozzle having a molten steel outlet whose lower side is opened, it is not clogged, and its life span is improved. Due to the improvement in the lifespan of the straight-type immersion nozzle, the time it takes to replace the straight-type immersion nozzle is shortened, and thus the number of consecutive heats of continuous casting increases.

In the case of a hole-type immersion nozzle, rapid corrosion occurs around holes formed in the lower portion thereof, so that the life span thereof is decreased, and the number of consecutive heats of continuous casting decreases. Further, due to the decrease in the life span thereof, the frequency of replacing a tundish increases.

Mold powder is supplied to the inner wall of the continuous casting mold 7 into which molten steel (m) is introduced. Mold powder is used to keep molten steel warm, to prevent the reoxidation of molten steel, to separate and float inclusion and to accelerate the lubrication between a solidified shell and a mold.

Mold powder includes CaO, $SiO_2$, $Al_2O_3$, $Na_2O$, F, and C.

When a straight-type immersion nozzle is employed, mold powder includes CaO in an amount of 32.7~33.7 wt %, $SiO_2$ in an amount of 29.3~30.3 wt %, $Al_2O_3$ in an amount of 8.90~9.90 wt %, $Na_2O$ in an amount of 1.8~2.8 wt %, F in an amount of 1.10~2.10 wt %, and C in an amount of 15.6~16.6 wt %, as main components. Mold powder may further include components having melting characteristics, such as fluorite, soda ash and the like, in addition to the main components.

The total amount of mold powder including fluorite, soda ash and the like in addition to the main components is set 100 wt %.

Among the components of mold powder, CaO, $SiO_2$ and $Al_2O_3$ participate in the separation and levitation of inclusion and the reoxidation of molten steel, and $Na_2O$ and F serve to adjust the viscosity and melting point of mold powder, accelerate the lubricating action and maintain heat transfer uniform. Further, C serves to adjust the melting rate of mold powder and keep molten steel warm.

When mold powder consists of the above components, the quality of a beam blank is improved, and the generation rate of seams is minimized. Seams are cracks generated parallel to the rolling direction.

Meanwhile, in the method of continuous casting a beam blank adapted for impact absorption according to embodiments of the present invention, compound continuous-continuous casting is employed. The compound continuous-continuous casting is a method of conducting continuous casting without drawing a cast piece after molten steel (m) stays in a continuous casting mold 7 and then a tundish 3 is replaced by another tundish.

For the convenience of explanation, terms of a beam blank and cast piece are used together.

In the compound continuous-continuous casting, the time it takes to replace a tundish 3 can be shortened compared to general continuous-continuous casting in which continuous casting is performed after a cast piece is drawn, a dummy bar is mounted, a mold is sealed and then a tundish is replaced. When the time it takes to replace a tundish 3 is shortened, continuous casting time is also shortened.

In compound continuous-continuous casting, the time it takes to replace a tundish 3 is set to less than 5 minutes. The reason for this is that, when the time it takes to replace a tundish 3 is more than 5 minutes, the end of the connection part of cast pieces is lifted up, so that there is the danger of causing an accident in the equipment and the problem of deteriorating the quality of a product.

The introduction rate of molten steel (m) introduced into the continuous casting mold 7 through the immersion nozzle 9 is 0.25~0.5 m/min for the first continuous casting cycle, and is 0.55~0.7 m/min for the second continuous casting cycle in which the tundish 3 is replaced to the final continuous casting cycle. In this case, the temperature drop of molten steel attributable to the replacement of the tundish is avoided, thus preventing the end of the connection part of cast pieces from being lifted up.

As shown in FIG. 4, in the compound continuous-continuous casting, the level of molten steel (m) staying in the continuous casting mold 7 is 25~35%. In this case, the level of molten steel (M) newly introduced into the continuous casting mold 7 after replacing the tundish 3 is maintained to be 65~75%, thus easily connecting cast pieces.

In the compound continuous-continuous casting, the molten steel (m) staying in the continuous casting mold 7 exists in a state in which its temperature drops to some degree, and the molten steel (M) newly introduced into the continuous casting mold 7 after replacing the tundish 3 in a state in which its temperature is high because its temperature does not drop. Therefore, when the level of molten steel (M) newly introduced into the continuous casting mold 7 after replacing the tundish 3 becomes high, cast pieces are easily connected.

When the level of molten steel (m) staying in the continuous casting mold 7 is less than 25% or more than 35%, cast pieces cannot be easily connected, and thus the end of the connection part of cast pieces can be lifted up.

When the level of the cast piece staying in the continuous casting mold 7 is less than 25%, the cast piece goes out of the continuous casting mold 7 before the outer circumference of a connection part 13 has solidified, and thus the connection between cast pieces becomes poor. Further, when the level thereof is more than 35%, the cast piece is rapidly cooled, and thus the connection between cast pieces becomes poor.

As shown in FIGS. 4 and 5, in order to connect the molten steel (m) staying in the continuous casting mold 7 to the molten steel (M) newly introduced into the continuous casting mold 7 after replacing the tundish 3, a connecting rod 11 is provided therebetween. In embodiments, the connecting rod 11 be provided at both ends thereof with grooves in order to easily connect the molten steel (m) staying in the continuous casting mold 7 with the molten steel (M) newly introduced into the continuous casting mold 7.

The connecting rod 11 is provided in the molten steel (m) at a location opposite to the location where the immersion nozzle 9 is disposed in the continuous casting mold 7 after mold powder is removed. In this case, the connecting rod 11 can be rapidly provided, thus decreasing the time waiting for continuous-continuous casting. The connecting rod 11 is provided, and then the molten steel (M) is introduced into the continuous casting mold 7.

Mold powder is removed in order to easily connect the molten steel (m) staying in the continuous casting mold 7 with the molten steel (M) newly introduced into the continuous casting mold 7.

When the connecting rod 11 is provided without removing the mold powder, the molten steel (m) staying in the continuous casting mold 7 is not easily connected with the molten steel (M) newly introduced into the continuous casting mold 7 because of the lubrication action of the mold powder.

Mold powder may be removed by stripping off it using a tool or by firing it using oxygen.

As such, the molten steel (M) continuously introduced into the continuous casting mold 7 is primarily cooled in the continuous casting mold 7, and is then formed at the outer circumference thereof with a solidification shell, and is simultaneously formed into a cast piece. This cast piece is discharged from the continuous casting mold 7, and is then transferred along a plurality of strands. The cast piece transferred along the plurality of strands is secondarily cooled by spraying cooling water to be completely solidified into a beam blank.

Meanwhile, the secondarily-cooled cast piece is straightened. In this case, in order to prevent the end of the connection part 13 of this cast piece from warping, cooling water is sprayed in a direction opposite to the warpage thereof. Cooling water is sprayed using a small-size spray (mist spray) provided at the lower portion of a simple guide. When done in this way, the phenomenon of the end of the connection part 13 of this cast piece being lifted up is prevented using the properties that metals expand or contract depending on temperature. Here, the simple guide is a pinch roll for guiding the secondarily-cooled cast piece to be straightened.

When a beam blank is formed through the above procedures, the connecting part 13, the quality of which is relatively low, is cut off, and only the remaining part of the beam blank is rolled into a desired product.

For reference, in the drawings, for the convenience of explanation, the size of the continuous casting mold 7 was exaggerated, and the reference numerals of molten steel were classified into "m" and "M". Here, the reason why the reference numerals of molten steel were classified into "m" and "M" is only that the molten steel (m) staying in the continuous casting mold 7 is distinguished from the molten steel (M) newly introduced into the continuous casting mold 7, not that the components of the molten steel (m) are different from those of the molten steel (M).

The following Table 1 shows the change in the number of consecutive heats of continuous casting depending on the use of an open nozzle or an immersion nozzle.

TABLE 1

| Class. | Comparative Example | Example |
|---|---|---|
| Kind of nozzle in tundish | Open nozzle (molten steel is introduced into continuous casting mold through two open nozzles using a semi-open nozzle) | Immersion nozzle (molten steel is introduced into continuous casting mold through one immersion nozzle) |
| Production | Production of steel adapted for impact absorption is impossible - open nozzle is clogged by the reoxidation of molten steel | Production of steel adapted for impact absorption is impossible |
| Number of consecutive heats of continuous casting | Average 50 | Average 22 |
| Replacing tundish | Replacing compound tundish | Replacing compound tundish |
| Quality of final rolled product | Gaseous defects (TIP cracks, seams) occur on the surface of rolled product | Quality of rolled product is improved by the prevention of gaseous defects |

In Comparative Example, the molten steel having undergone a refining process is introduced into a tundish 3 from a ladle 1, and then the molten steel (m) charged in the tundish 3 is introduced into a continuous casting mold 7 through open nozzles 5 (refer to FIG. 1), and, in Example, the molten steel (m) charged in the tundish 3 is introduced into a continuous casting mold 7 through an immersion nozzle 9 (refer to FIG. 3). Here, the reference numeral "11" designates a position at which a connecting rod is provided in molten steel.

As shown in Table 1, it can be ascertained that, in continuous casting, when the molten steel charged in the tundish is introduced into the continuous casting mold through the immersion nozzle, the number of consecutive heats of continuous casting decreases, but it is possible to reduce nozzle clogging caused by the reoxidation of molten steel, and thus steel adapted for impact absorption can be effectively produced.

The following Table 2 shows the generation rate of seams according to the components of mold powder.

For reference, the mold powder of Comparative Example is mold powder when open nozzles are used, and the mold powder of Example is mold powder when an immersion nozzle is used.

TABLE 2

| Class. | | Comparative Example | Example | comparison |
|---|---|---|---|---|
| Mold powder | basicity ($CaO/SiO_2$) | 1.20 | 1.11 | |
| | CaO (wt %) | 34.10 | 33.20 | |
| | $SiO_2$ (wt %) | 28.36 | 29.80 | |
| | $Al_2O_3$ (wt %) | 11.80 | 9.40 | |
| | $Na_2O$ (wt %) | 0.1 | 2.3 | |
| | F (wt %) | 1.84 | 1.60 | |
| | C (wt %) | 15.26 | 16.1 | |
| | viscosity (poise, 1300° C.) | 12.9 | 10.2 | |
| | melting point (° C.) | 1256 | 1260 | |

TABLE 2-continued

| Class. | | Comparative Example | Example | comparison |
|---|---|---|---|---|
| Quality of final rolled product | seams (%) | 6.5 | 2.8 | 3.7 percent points reduced |

From Table 2, it can be presumed that the generation rate of seams is decreased when the mold powder of the Example was used compared to when the mold powder of the Comparative Example was used.

The following Table 3 shows the change in the number of consecutive heats of continuous casting depending on the type of an immersion nozzle.

TABLE 3

| Class. | Comparative Example | Example | comparison |
|---|---|---|---|
| Type of immersion nozzle | hole type | straight type | — |
| Number of consecutive heats of continuous casting | 8 | 22 | 14 |

From Table 3, it can be presumed that, when a straight-type immersion nozzle is used, the life span thereof is increased, and thus the number of consecutive heat of continuous casting increases.

Therefore, it can be ascertained that the problem of decreasing the number of consecutive heats of continuous casting can be avoided as open nozzles are not used and the straight-type immersion nozzle is employed.

The following Table 4 shows the change in the time it takes to replace a tundish depending on the conditions of continuous-continuous casting.

TABLE 4

| Class. | Comparative Example | Example | comparison |
|---|---|---|---|
| Continuous casting | general continuous-continuous casting (tundish is replaced after cast piece is drawn and then dummy bar is mounted) | compound continuous-continuous casting (tundish is replaced without drawing cast piece after cast piece stays in continuous casting mold) | |
| Tundish replacing time (min) | 80 | 5 | −75 |
| Introduction rate of molten steel (m/min) | 0.5 | 30 | |
| Level of molten steel in continuous casting mold (%) | 70 | | |
| Simple guide | — | small-size spray is provided at lower portion of simple guide | |
| Loss of connection part of cast piece | 6.5 | 2.0 | |
| Lifting up of end of connection part of cast piece | non occurrence | non occurrence | |

From Table 4, it can be presumed that, in the compound continuous-continuous casting, the time it takes to replace a tundish is shortened, and thus the continuous-continuous casting time can be shortened, and that it is possible to prevent the end of the connection part of a cast piece from being lifted up when the introduction rate of molten steel in the continuous casting mold and the level of molten steel in the continuous casting mold are adjusted and a small-size spray is additionally provided at a simple guide to spray cooling water.

Further, it can be presumed that, in compound continuous-continuous casting, there is decreased damage to the connection part (front end and rear end of cast piece) of a cast piece, thus increasing the recovery rate thereof.

As described above, according to embodiments of the present invention, the reoxidation of molten steel is prevented by using an immersion nozzle, the problem of decreasing the number of consecutive heats of continuous casting can be avoided as open nozzles are not used and the straight-type immersion nozzle is employed, and continuous-continuous casting time is shortened by applying compound continuous-continuous casting.

Further, the problem of lifting up the end of connection part of a cast piece, which can occur during compound continuous-continuous casting, is prevented by adjusting the level of molten steel staying in the continuous casting mold and by adjusting the introduction rate of molten steel in the continuous casting mold after replacing a tundish.

Therefore, when the method of continuous casting a beam blank adapted for impact absorption according to embodiments of the present invention is used, it is possible to produce steel adapted for low-temperature impact absorption, the quality of a product is made excellent by preventing the gaseous defects of expandable materials, and productivity is improved due to the increase in the number of consecutive heats of continuous casting.

Although embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of continuously casting molten steel into a beam blank comprising a first flange portion, a second flange portion and a neck portion interconnecting the first and second flange portions, the method comprising:

providing a mold for the beam blank, the mold comprising a first flange-forming region, a second flange-forming region and a neck-forming region located between the first flange-forming region and the second flange-forming region;

introducing a first molten steel composition into the mold via a nozzle outlet disposed in the first flange-forming region of the mold and immersed in the first molten steel composition cast in the first flange-forming region of the mold;

placing a connecting rod within the second flange-forming region such that a substantial portion of the connecting rod is immersed in the first molten steel composition cast in the second flange-forming region of the mold;

introducing a second molten steel composition into the first flange-forming region of the mold so that the second molten steel composition is cast over the first molten steel composition cast in the mold and that the connecting rod is immersed in the second molten steel composition cast in the mold; and cooling the first and second molten steel compositions to form the beam blank, which comprises the connecting rod in the second flange thereof.

2. The method of claim 1, wherein the outlet of the nozzle is open downward.

3. The method of claim 1, further comprising, prior to placing the connecting rod, removing mold powder.

4. The method of claim 1, wherein casting is performed without drawing a cast piece while the first molten steel composition stays in the mold prior to the introduction of the second molten steel composition.

5. The method of claim 4, wherein the rate of introducing the second molten steel composition into the mold ranges from 0.55 m/min to 0.7 m/min.

6. The method of claim 1, wherein the level of the first molten steel composition staying in the mold is maintained from 25% to 35% prior to the introduction of the second molten steel composition.

7. The method of claim 1, further comprising supplying mold powder to the mold, wherein the mold powder comprises CaO in an amount of 32.7~33.7 wt %, $SiO_2$ in an amount of 29.3~30.3 wt %, $Al_2O_3$ in an amount of 8.90~9.90 wt %, $Na_2O$ in an amount of 1.8~2.8 wt %, F in an amount of 1.10~2.10 wt % and C in an amount of 15.6~16.6 wt %.

8. The method of claim 1, further comprising, prior to introducing the second molten steel composition, removing mold powder staying in the mold.

9. The method of claim 1, wherein the first molten steel composition is introduced from a first tundish, and the second molten steel composition is introduced from a second tundish, wherein the method further comprises replacing the first tunish with the second tundish comprising, prior to introducing the second molten steel, replacing tundishes.

* * * * *